United States Patent [19]

Heinzel

[11] Patent Number: 4,561,622

[45] Date of Patent: Dec. 31, 1985

[54] FOLDING TABLE CATCH

[76] Inventor: Eberhard Heinzel, Klosterweg 11, D-5789 Hallenberg, Fed. Rep. of Germany

[21] Appl. No.: 520,465

[22] Filed: Aug. 4, 1983

[30] Foreign Application Priority Data

Aug. 5, 1982 [DE] Fed. Rep. of Germany ..... 3229210

[51] Int. Cl.[4] ..... F16M 11/32

[52] U.S. Cl. ..... 248/439; 108/131; 248/188.6

[58] Field of Search ..... 248/440, 439, 440.1, 248/188.6; 108/129, 130, 131, 132, 133; 403/117, 88, 93, 106

[56] References Cited

U.S. PATENT DOCUMENTS

| | | | |
|---|---|---|---|
| 1,941,264 | 12/1933 | McIntosh | 74/548 X |
| 2,666,339 | 1/1954 | Schwarz | 74/548 X |
| 2,690,942 | 10/1954 | Marcus | 108/132 X |
| 2,815,237 | 12/1957 | Winterburn | 74/548 X |
| 2,823,087 | 2/1958 | Zimmer | 108/132 X |
| 3,554,141 | 11/1971 | Burr . | |
| 4,266,678 | 5/1981 | Daly | 211/194 |
| 4,368,675 | 1/1983 | Propst | 211/194 X |

FOREIGN PATENT DOCUMENTS

| | | | |
|---|---|---|---|
| 7316469 | 5/1973 | Fed. Rep. of Germany . | |
| 317477 | 8/1974 | Fed. Rep. of Germany . | |
| 2508726 | 9/1976 | Fed. Rep. of Germany | 108/132 |
| 50523 | 12/1940 | France | 108/131 |

*Primary Examiner*—J. Franklin Foss

*Attorney, Agent, or Firm*—Young & Thompson

[57] ABSTRACT

A folding table catch (1) with pivotable table leg trestles (2) below the table place (21) and with a locking device under spring tension for locking the erected table leg trestles, displays an automatically locking, releaseable locking device (8) in both its erected and its folded position, displaying at each of both ends of a connecting rod (9) pivoted parallel to the swivel axis of the table leg trestle (2), a cam plate (10) with locking surfaces for a locking cam attached to a round pipe (5) which forms the swivel axis of the table leg trestle (2). Between at least one of the cam plates (10) and its associated locking cam, a torsion spring surrounding the round pipe (5) is employed, which is prestressed in the one direction of rotation in the folded position of the associated table leg trestle (2) and in the other direction of rotation when in the folded position of the table leg trestle (2) and is unstressed when in an intermediate position. An elongation of each cam plate (10) is designed as a release lever for the locking device (8).

6 Claims, 6 Drawing Figures

Figures 1, 1A:
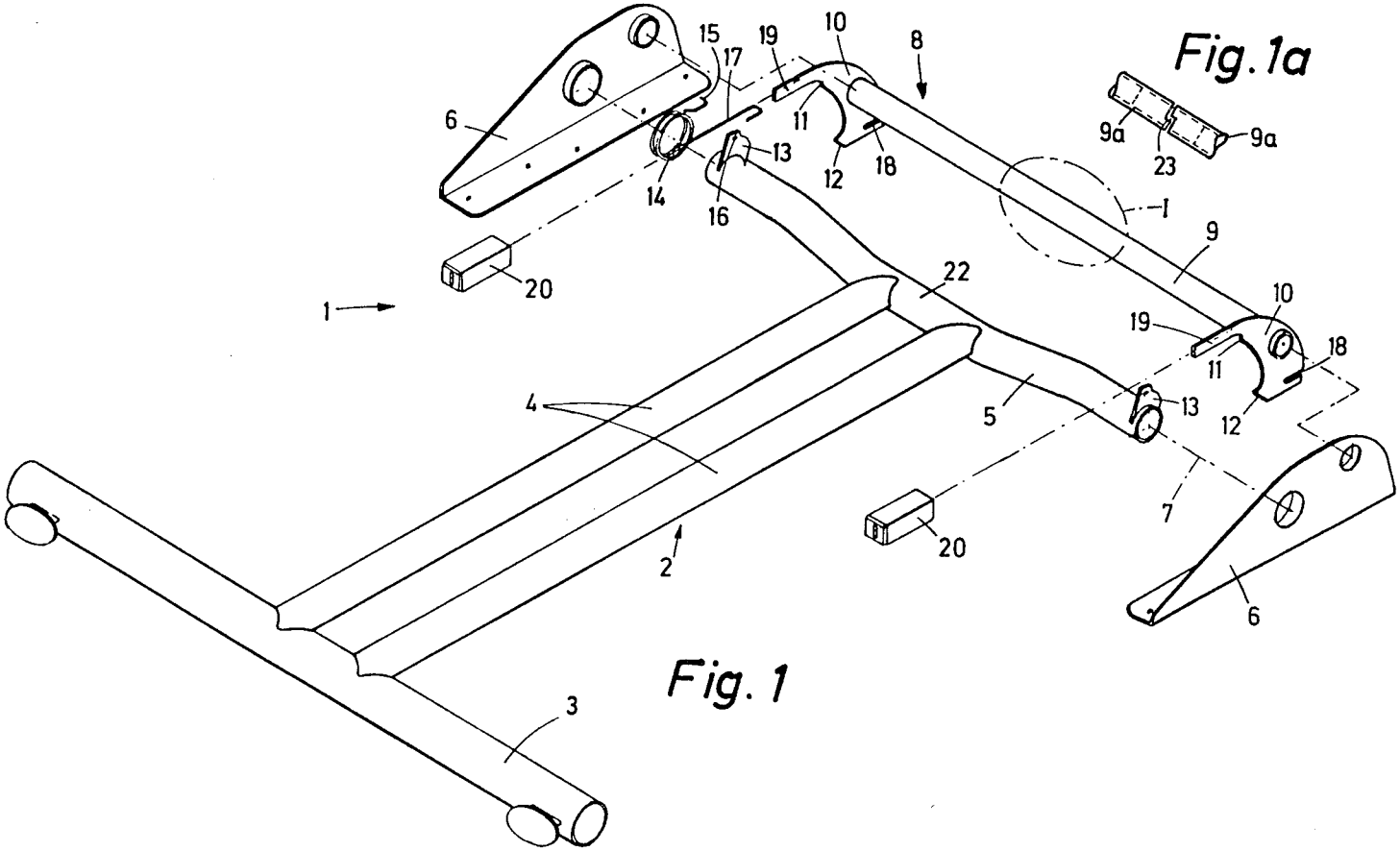

1
2
3
4
5
6
7
8
9
9a
10
11
12
13
14
15
16
17
18
19
20
22
23

FOLDING TABLE CATCH

The invention pertains to a set of catches for a folding table with swiveling table leg trestles below the table plate and with a spring-stressed locking device for clamping the raised table leg trestles.

One such folding table catch is familiar from e.g. DE-GM No. 75 06 256. This folding table catch has no locking mechanism for the folded table leg trestle. Unlocking from the folded position is somewhat complicated and with respect to the danger of possible injury, is not fully unobjectionable. Since with this particular embodiment a locking component in the form of a plate with a V-notch is employed, which pivots around an axis arranged below the table plate vertically to the pivot axis of the particular table leg trestle, said V-notch accepting a transverse spar of the table plate and locking when in unfolded position, a rocking of the table can ensue despite an adjustable conical bearing.

These disadvantages also exist with a folding table catch familiar from the U.S. Pat. No. 3 695 567, with which there is not even the possibility of an adjustment and which requires very close production tolerances if a rocking of the table is to be avoided. The stacking capability of this table also leaves much to be desired in several respects.

The invention is based upon the task of creating a set of folding table catches which, with a few simple components, will make possible a play-free and stable locking of the table leg trestle in erected position and a secure locking in its folded state and which is simple to operate.

For the resolution of this task the folding table catch under application, starting from that of the type remarked initially, is characterized by a releaseable, automatically clamping locking device associated with the table leg trestle in both erected and folded positions.

In a further embodiment of the invention, the locking device displays at each of both ends of a connecting pipe pivoted parallel to the swivel axis of the table leg trestle, a cam plate with locking surfaces for a locking cam fastened to a round pipe which forms the swivel axis of the table leg trestle, and between at least one of the cam disks and its associated locking cams, a torsion spring surrounding the round pipe is inserted, which is prestressed in the folded position of the associated table leg trestle in the one rotation direction and, in the erected position of the table leg trestle, is prestressed in the other rotation direction and which is unstressed in an intermediate position.

An extension of each cam plate is expediently designed as a lock release device and, at the extensions of all cam plates, grips of plastic material are placed which serve as stacking buffers for the positioning of the table plate of the next higher table of a stack of folding tables.

A further characteristic is also to be found in the fact that a connection rod is fastened at the foot section of each table leg trestle to a component section of the round pipe displaced from the pivot axis and that the component section of the pipe of the one table leg trestle is displaced contrarotating to the component section of the round pipe of the other table leg trestle in such a way that when the table leg trestles are folded, the connecting rods of the same lie above and parallel to each other.

To avoid the possibility that with a warping of the table plate the functioning of the locking device would be adversely affected, the connection pipe of each locking device can be divided at a point along its length while providing a minimal rotational slippage. This is merely a preventative measure which in a normal situation is not necessary since the folding table catch under application is, in any case, not susceptible to fine production tolerances and the application of this measure is dependent upon the stability of the table plate in use.

A safe locking of the folding table catch is not least achieved by the fact that the round pipe of each table leg trestle and the connection pipe of the associated locking device are so seated at their ends in bearing angles secured to the table plate and that the locking surfaces of the cam plates and the locking cams are arranged in such a way that when the table leg trestle is erected, the force line of a force operating in the unlocking direction on the locking surface of the cam plate is displaced to the axis of the connection pipe of the locking device in such a way that a torque is generated at the cam plate in the direction of locking, i.e., the locking is automatic. In the course of this, the locking cams brace upon bearing angles fastened to the table plate when the table leg trestle is erected.

Further advantages of the folding table catch under application, in addition to the small number of simple single components, are the simple and quick assembly of the catch (e.g., the torsion spring can be hung free of stressing), as well as the simple operation of the catch: only one release lever needs to be operated briefly on each side of the table in order to bring the table leg trestle into the desired position, whereby the torsion springs are stressed automatically in the corresponding direction so as to assure the locking. Through the connecting pipe, the locking ensues simultaneously on both sides of a single catch. The configuration of the table leg trestle is independent of the catch system. All forces which are liberated are first absorbed by the catch and then transmitted to the table plate over an adequate static length of the bearing angles. Since the construction is essentially based upon stamped parts and is of itself simple, a cost-effective production of the folding table catch is made possible. Folding tables equipped with this catch can be stacked with the table plate up or down and, for the removal of individual tables, sufficient gripping room is provided between the stacked tables.

Figure 2:
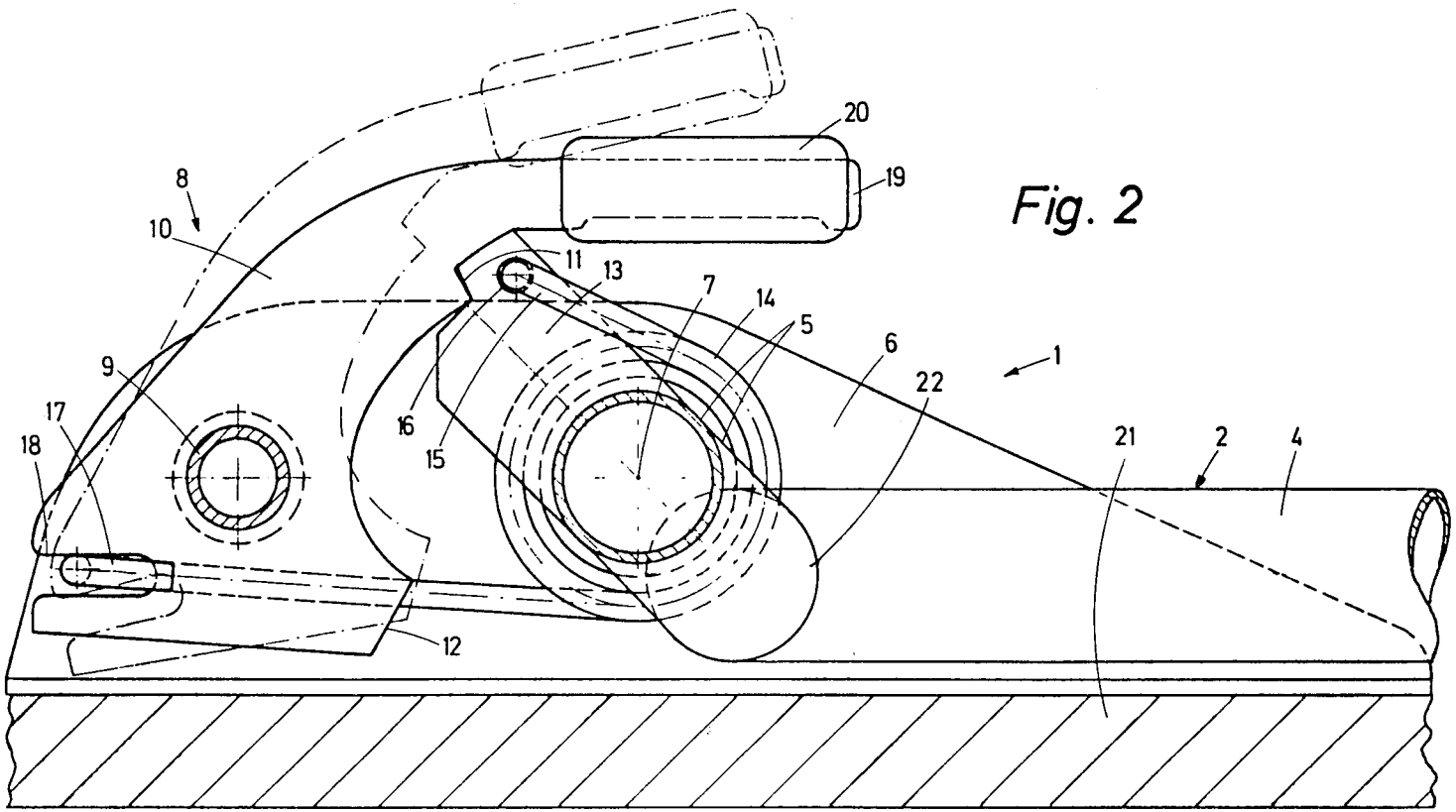
Figure 3:
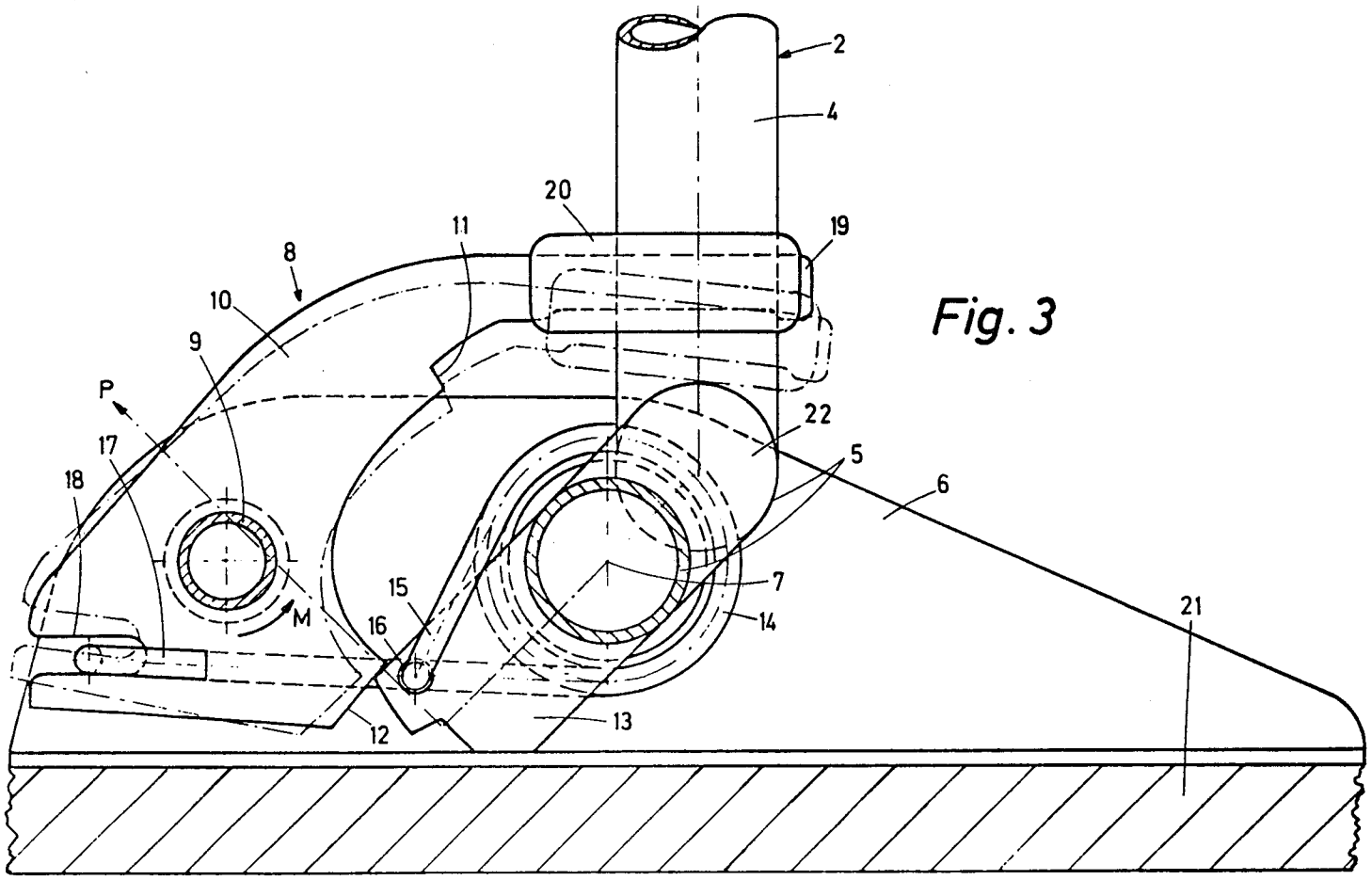
Figure 4:
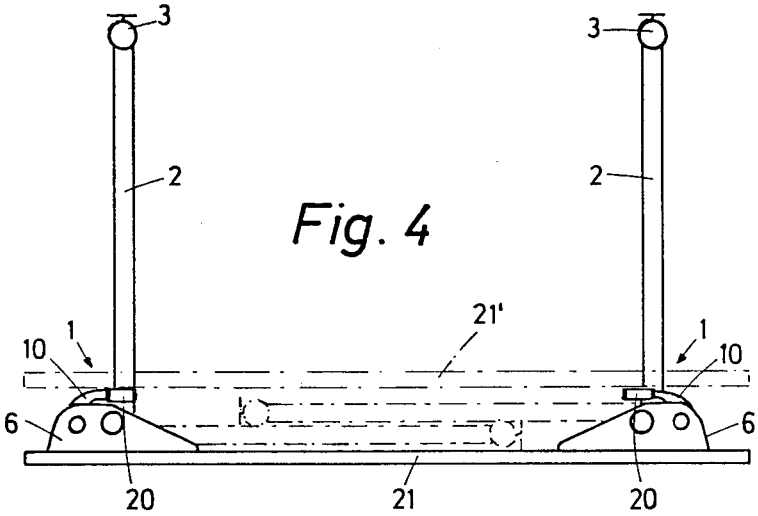
Figure 5:
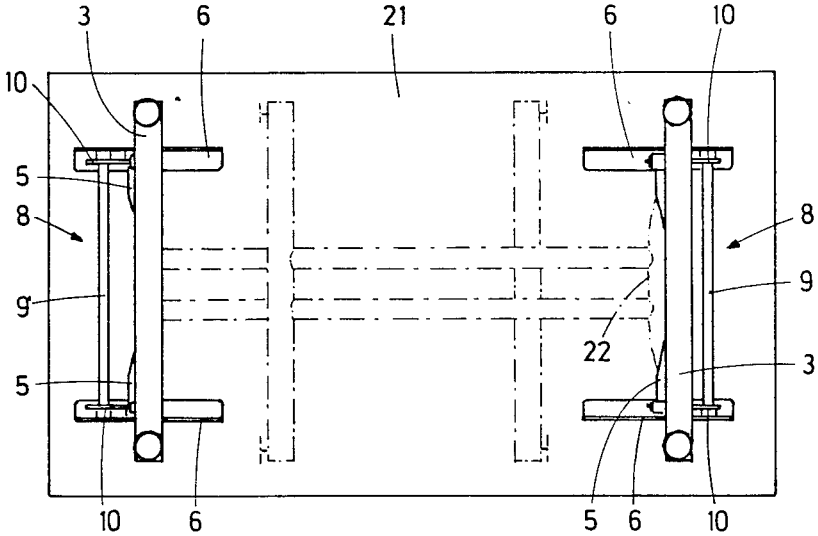

One embodiment of the invention is shown in the drawings. Indicated are:

FIG. 1 the individual components of a folding table catch in exploded perspective representation, FIG. 1*a* an alternative embodiment roughly in section I of FIG. 1, FIG. 2 a side view of the folding table catch in cross section with the table leg trestle closed, FIG. 3 the same side view in cross section with the table leg trestle erected, FIG. 4 a side view of the complete table whereby the stacking possibilities are indicated, and FIG. 5 a view of the lower side of a folding table.

The mode of operation of the folding table catch 1 will not be elaborated using the FIGS. 2 and 3, whereby reference will be made to FIGS. 4 and 5.

FIG. 2 shows the folding table catch 1 with the table leg trestle 2 folded. The connecting rod 4 of the table leg trestle 2, which is located near the one narrow end of the table, e.g., to the right in FIG. 4, is fastened to a section 22 of the round pipe 5 displaced to the table plate 21. With the folding table 1 at the opposite narrow side of the table, the connection rod 4 is fastened to the round pipe 5 in such a way that the partial section 22 is displaced away from the pivot axis 7 so that, as shown in FIG. 4, the table leg trestles 2 can be laid parallel above each other. In doing so, they do not extend past the grip pieces 20, so that upon these the table plate 21' of an additional table can be laid for the purpose of stacking. FIG. 4 also shows that sufficient gripping space is available during unstacking. The table leg trestles 2 are locked in their folded mode in accordance with FIG. 2 since the locking surfaces 11 of the cam plate 10 abut on their corresponding surfaces of the locking cam 13 attached to the round pipe 5. The torsion spring 14 is stressed in this position for locking, i.e., it has the tendency in the position according to FIG. 2 to rotate spring wing 17 and, thereby, the disk cam 10 clockwise. Further, it can be seen from FIGS. 2 and 4 that the stacking forces are initially transmitted by way of the table catch 1 to the bearing angles 6, before they pass over to the table plate 21 to which the bearing angles are screwed, by way of a relatively large surface of the bearing angles 6. The attachment screws are not shown. The folded position (stacking position) of the folding table catch 2 is indicated by dotted lines in FIGS. 4 and 5.

For unfolding the folding table catch 1 into the position shown in FIG. 3, the cam plates 10 of each catch 1 are moved into the position shown by the dotted lines in FIG. 2 by the extensions 19 at the point of the grip of each catch 1, so that the locking surfaces 11 come out of engagement with the associated locking cams 13. In an intermediate phase, i.e., approximately in the middle of the unfolding motion, the torsion spring 14 is unstressed, so that it can easily be fitted into such a position during assembly of the catch 1. In the erected position according to FIG. 3, the locking cams 13 come to rest upon the bearing angle 6, the table leg trestles 2 stand vertical to the table plate 21 and the torsion spring 14 is now stressed in such a way that it has the tendency to rotate the cam plates 10 counterclockwise, whereby the locking surfaces 12 of the cam plates 10 automatically engage in the locking cams 13. In this position as well, all forces operating upon the table legs 2 are transmitted favorably to the catch 1 and the table plate 21, specifically in the one direction by the emplacement of the locking cams 13 at the bearing angles 6 and in the other direction by the way of the locking surfaces 12 upon the locking device 8. In FIG. 3 the force line of a force P is indicated. As can be seen, this force line is displaced toward the axis of the connection pipe 9 of the locking device 8 in such a way that the force P produces a torque M which has the tendency, like the torsion spring 14, to rotate the cam plate 10 counterclockwise, i.e., for the purpose of locking, so that the locking is tighter rather than loosened. For folding of the table leg trestle 2, the grip 20 is pressed in the direction toward the table plate 21, i.e., the cam plates 10 of the catch 1 are turned clockwise against the force of the torsion spring 14 so that the locking surfaces 12 come out of engagement with the locking cams 13. The release position of the cam plate 10 is shown in FIG. 3 with dotted lines. The table leg trestle 2 associated with this folding table catch 1 can now be folded. At the point of the second half of the folding movement, the torsion spring 14 is thereby prestressed in the other direction so that, upon reaching the folded position shown in FIG. 2, the locking device 8 again engages automatically. The table, prepared in this way, can now be stacked with the table plate 21 either down (normally) or up, since in each position of the table leg trestle 2, a secure locking of the same is assured.

In order to assure a secure locking of a possibly damaged table plate 21 by way of the cam plates 10 operating simultaneously by way of the connecting pipe 9*a*, a minimal rotational slippage of the connection pipe (s. FIG. 1*a*) is provided.

The described folding table catch 1 is largely independent of the configuration of the table leg trestle 2. Thus, for example, the pipes of the connection rod 4 can be attached outside the bearing angle 6 to the round pipe 5, whereby the displaced portion 22 of the round pipe 5 is replaced by a correspondingly eccentric application of the connecting rod 4 to the round pipe 5. With such an embodiment, however, the bearing angles 6 must be placed upon the round pipe 5 before the attachment of the connecting rod 4 and the entire catch 1, with the locking device 8, would have to be preassembled. Of course, the pipes of the connecting rod 4 could be attached to the round pipe 5 more toward the ends, though within the bearing angles 6, with a corresponding eccentricity and do not necessarily have to run parallel to each other.

I claim:

1. A folding table fitment with table leg assemblies which are pivotal about a pivot axis into a position under the table top member, and a spring-loaded retaining means for latching the table leg assemblies in an unfolded position, a connecting tube which is mounted pivotally parallel to the axis of pivotal movement of the table leg assembly, the retaining means including, at each end of said tube, a respective cam plate having latching surfaces for a latching cam secured to a round tube forming said pivot axis of the table leg assembly, and a torsion spring between at least one of the cam plates and the associated said latching cam, said spring encircling the round tube and being stressed in one direction of rotary movement in the folded position of the associated table leg assembly and being stressed in the other direction of rotary movement in the unfolded position of the table leg assembly and being unstressed in an intermediate position of the table leg assembly between said folded and unfolded positions.

2. A folding table fitment according to claim 1, and an extension portion on each cam plate formed as a release lever for the retaining means, and grip members of plastics material fitted onto the extension portions of all said cam plates, said grip members serving as stacking buffers for supporting the table top member of the next higher table.

3. A folding table fitment according to claim 1, there being two said table leg assemblies, and a connecting arrangement for the base portion of each table leg assembly secured to a portion of the round tube, which is displaced out of said axis of pivotal movement, the portion of the round tube of the one table leg assembly being displaced in the opposite direction relative to the portion of the round tube of the other table leg assembly in such a way that, when the table leg assemblies are in the folded position, the connecting arrangements thereof lie parallel one above the other.

4. A folding table fitment according to claim 1, in which the connecting tube of each retaining means is divided in two portions at a location on its length, with the provision of a small amount of rotary slippage between said two portions.

5. A folding table fitment according to claim 1, in which the round tube of each table leg assembly and the connecting tube of the associated retaining means are mounted at their ends in angle mounting members secured to the table top member in such a way, and the latching surfaces of the cam plates and the latching cams are arranged in such a way, that, when the table leg assembly is in the unfolded position, the line of action of a force which engages the latching surface of the cam plates and which acts in the unlatching direction is so displaced relative to the axis of the connecting tube of the retaining means that a rotary moment is produced at the cam plate in the latching direction, whereby the latching action is self-locking.

6. A folding table fitment according to claim 1, in which, when the table leg assembly is in the unfolded position, the latching cams bear against angle mounting members which are secured to the table top member.

* * * * *